US006073462A

United States Patent [19]

Wong et al.

[11] Patent Number: 6,073,462

[45] Date of Patent: Jun. 13, 2000

[54] CRYOGENIC AIR SEPARATION SYSTEM FOR PRODUCING ELEVATED PRESSURE OXYGEN

[75] Inventors: Kenneth Kai Wong, Amherst; Dante Patrick Bonaquist, Grand Island; James Bragdon Wulf, Williamsville, all of N.Y.

[73] Assignee: Praxair Technology, Inc., Danbury, Conn.

[21] Appl. No.: 09/280,575

[22] Filed: Mar. 30, 1999

[51] Int. Cl.[7] ..... F25J 3/02

[52] U.S. Cl. ..... 62/654

[58] Field of Search ..... 62/654

[56] References Cited

U.S. PATENT DOCUMENTS

| | | | |
|---|---|---|---|
| 5,265,429 | 11/1993 | Dray | 62/654 |
| 5,398,514 | 3/1995 | Roberts et al. | 62/38 |
| 5,440,884 | 8/1995 | Bonaquist et al. | 62/654 |
| 5,546,766 | 8/1996 | Higginbotham | 62/654 |
| 5,564,290 | 10/1996 | Bonaquist et al. | 62/646 |
| 5,600,970 | 2/1997 | Drnevich et al. | 62/651 |
| 5,655,388 | 8/1997 | Bonaquist et al. | 62/651 |
| 5,692,396 | 12/1997 | Rathbone | 62/654 |
| 5,765,396 | 6/1998 | Bonaquist | 62/646 |
| 5,802,873 | 9/1998 | Howard | 62/646 |
| 5,829,271 | 11/1998 | Lynch et al. | 62/646 |

OTHER PUBLICATIONS

Paine et al., "Dual Pressure Ratio Compressor", Gas Turbine and Aeroengine Congress and Exposition, Toronto, Ontario, Canada (1989).

*Primary Examiner*—Ronald Capossela
*Attorney, Agent, or Firm*—Stanley Ktorides

[57] ABSTRACT

A cryogenic air separation system employing a double column wherein lower pressure column bottom liquid is pressurized in a single cryogenic liquid pump to provide driving fluid for the main condenser and to provide product elevated pressure oxygen.

10 Claims, 1 Drawing Sheet

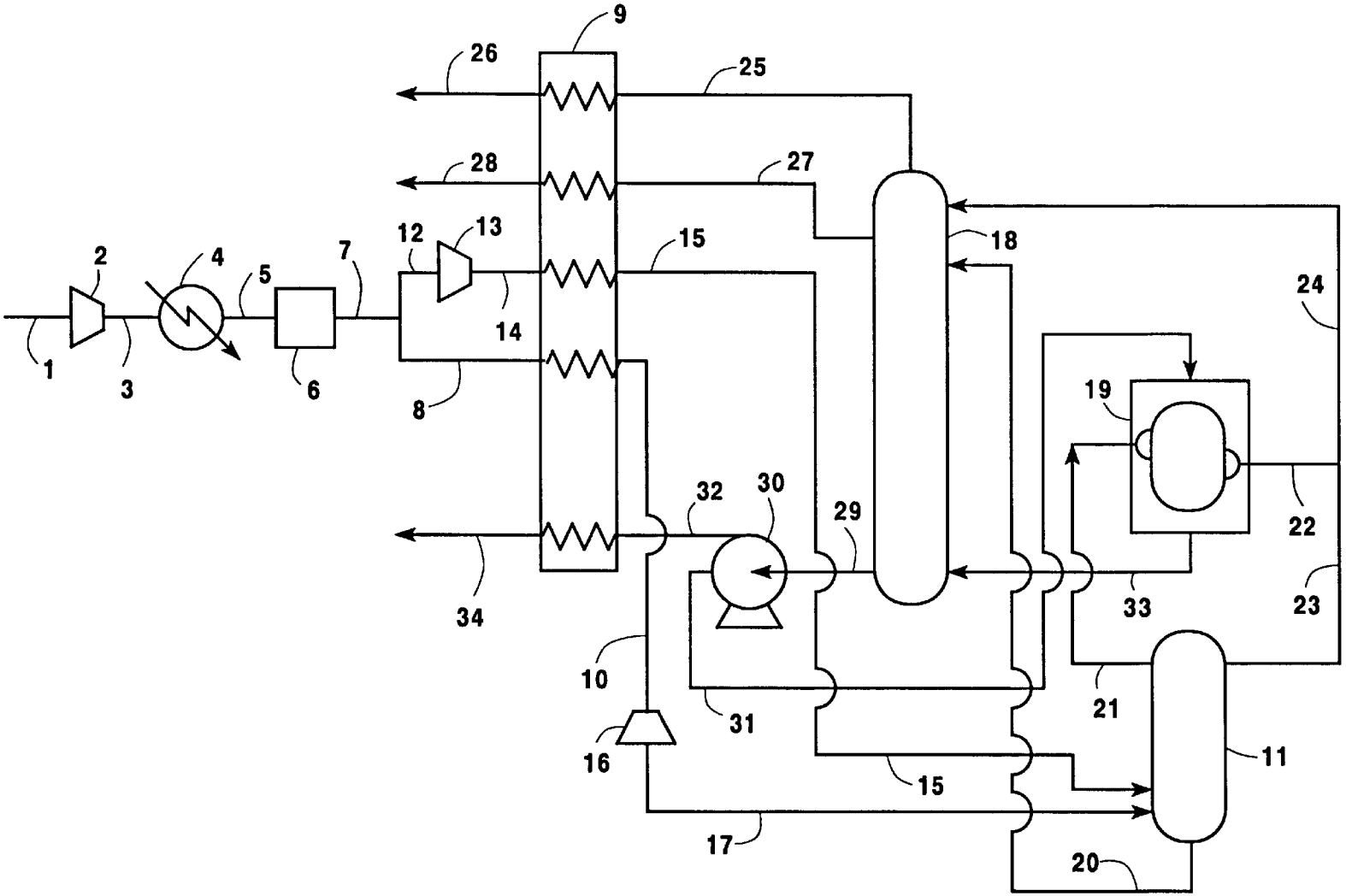
1
2
3
4
5
6
7
8
9
10
11
12
13
14
15
16
17
18
19
20
21
22
23
24
25
26
27
28
29
30
31
32
33
34

CRYOGENIC AIR SEPARATION SYSTEM FOR PRODUCING ELEVATED PRESSURE OXYGEN

TECHNICAL FIELD

This invention relates generally to the cryogenic rectification of feed air and, more particularly, to the production of elevated pressure oxygen.

BACKGROUND ART

Oxygen is produced commercially in large quantities by the cryogenic rectification of feed air, generally employing a double column system wherein product oxygen is taken from a lower pressure column. At times it may be desirable to produce oxygen at a pressure which exceeds its pressure when taken from the lower pressure column. In such instances, gaseous oxygen may be compressed to the desired pressure. However, it is generally preferable for capital cost purposes to remove oxygen as liquid from the lower pressure column, increase its pressure, and then vaporize the pressurized liquid oxygen to produce the desired elevated pressure product oxygen gas.

It is desirable in such a system to produce the elevated pressure oxygen product as efficiently as possible. Accordingly, it is an object of this invention to provide a cryogenic air separation system which can produce elevated pressure oxygen with improved efficiency and lower cost than heretofore available cryogenic air separation systems for producing such elevated pressure oxygen.

SUMMARY OF THE INVENTION

The above and other objects, which will become apparent to those skilled in the art upon a reading of this disclosure, are attained by the present invention, one aspect of which is:

A method for producing elevated pressure oxygen comprising:

(A) cooling feed air and passing the cooled feed air into a cryogenic air separation plant comprising a higher pressure column, a lower pressure column and a main condenser;

(B) separating the feed air within the cryogenic air separation plant by cryogenic rectification to produce oxygen;

(C) passing a liquid stream of oxygen from the lower portion of the lower pressure column to a liquid pump and increasing the pressure of the oxygen passed to the liquid pump to produce elevated pressure oxygen;

(D) passing a first stream of elevated pressure oxygen from the liquid pump to the main condenser; and (E) recovering a second stream of elevated pressure oxygen from the liquid pump as elevated pressure oxygen product.

Another aspect of the invention is:

Apparatus for producing elevated pressure oxygen comprising:

(A) a cryogenic air separation plant comprising a higher pressure column, a lower pressure column and a main condenser, and means for passing feed air into the cryogenic air separation plant;

(B) means for passing fluid from the higher pressure column to the main condenser, and means for passing fluid from the main condenser to the lower pressure column;

(C) a liquid pump and means for passing fluid from the lower portion of the lower pressure column to the liquid pump;

(D) means for passing fluid from the liquid pump to the main condenser; and (E) means for recovering fluid from the liquid pump as product elevated pressure oxygen.

As used herein the term "oxygen" means a fluid having an oxygen concentration of at least 50 mole percent and preferably at least 90 mole percent.

As used herein, the term "feed air" means a mixture comprising primarily nitrogen and oxygen, such as ambient air.

As used herein, the term "product boiler" means a heat exchanger wherein liquid oxygen is vaporized, generally by indirect heat exchange with feed air which is condensed. The product boiler may be a separate heat exchanger or may be a portion of the primary heat exchanger associated with the cryogenic air separation plant.

As used herein, the terms "turboexpansion" and "turboexpander" means respectively method and apparatus for the flow of high pressure gas through a turbine to reduce the pressure and the temperature of the gas.

As used herein, the term "column" means a distillation or fractionation column or zone, i.e. a contacting column or zone wherein liquid and vapor phases are countercurrently contacted to effect separation of a fluid mixture, as for example, by contacting or the vapor and liquid phases on a series of vertically spaced trays or plates mounted within the column and/or on packing elements which may be structured packing and/or random packing elements. For a further discussion of distillation columns see the Chemical Engineers' Handbook fifth edition, edited by R. J. Perry and C. H. Chilton, McGraw-Hill Book Company, New York, Section 13, *The Continuous Distillation Process*. The term, double column is used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeably termed rectification columns, distillation columns, or fractionation columns. Cryogenic rectification is a rectification process carried out, at least in part, at temperatures at or below 150 degrees Kelvin (K).

As used herein, the term "indirect heat exchange" means the bringing of two fluids into heat exchange relation without any physical contact or intermixing of the fluids with each other.

As used herein, the terms "upper portion" and "lower portion" of a column mean those portions respectively above and below the midpoint of the column.

As used herein, the term "main condenser" means a heat exchanger wherein vapor from the upper portion of a higher pressure column is condensed by indirect heat exchange with liquid from the lower portion of a lower pressure column.

As used herein, the term "thermo-syphon main condenser" means a main condenser wherein vapor from the upper portion of the higher pressure column is condensed by indirect heat exchange with oxygen-rich liquid from the lower portion of the lower pressure column such that the liquid flows upward through tubes or heat exchanger passages as it boils exiting as a vapor and liquid.

As used herein, the term "downflow main condenser" means a main condenser where vapor from the upper portion of the higher pressure column is condensed by indirect heat exchange with oxygen-rich liquid from the lower portion of the lower pressure column such that the oxygen-rich liquid flows downward through tubes or heat exchanger passages as it boils exiting as a vapor and liquid.

As used herein the term "liquid pump" means a device that raises the pressure of a liquid stream

BRIEF DESCRIPTION OF THE DRAWING

The sole FIGURE is a simplified schematic representation of one preferred embodiment of the invention wherein the cryogenic air separation plant comprises a vertically oriented double column arrangement. The invention may also be practiced with a cryogenic air separation plant comprising a side-by-side double column arrangement.

DETAILED DESCRIPTION

The invention will be described in detail with reference to the Drawing. Referring now to the FIGURE, feed air 1 is increased in pressure by passage through compressor 2 to a pressure generally within the range of from 50 to 500 pounds per square inch absolute (psia), and resulting pressurized feed air 3 is cooled of the heat of compression by passage through cooler 4. Resulting feed air 5 is then cleaned of high boiling impurities such as carbon dioxide, water vapor and hydrocarbons by passage through purifier 6 to produce cleaned, pressurized feed air 7.

A first portion 8 of feed air 7, generally comprising from about 50 to 95 percent of feed air 7, is passed through primary heat exchanger 9 wherein it is cooled by indirect heat exchange with return streams. Resulting cooled first feed air portion 10 is turboexpanded by passage through turboexpander 16 to generate refrigeration and the resulting tuboexpanded first feed air portion 17 is passed into first or higher pressure column 11 of the cryogenic air separation plant which also includes second or lower pressure column 18 and main condenser 19.

A second portion 12 of feed air 7, generally comprising from about 5 to 50 percent of feed air 7, is boosted in pressure by passage through booster compressor 13 to a pressure generally within the range of from 50 to 1000 psia. Resulting further pressurized second feed air portion 14 is cooled by passage through primary heat exchanger 9 by indirect heat exchange with vaporizing elevated pressure liquid oxygen as will be more fully discussed below, and resulting cooled second feed air portion 15 is passed into higher pressure column 11.

Higher pressure column 11 is operating at a pressure generally within the range of from 50 to 300 psia. Within higher pressure column 11 the feed air is separated by cryogenic rectification into oxygen-enriched liquid and nitrogen-enriched vapor. Oxygen-enriched liquid is withdrawn from the lower portion of higher pressure column 11 in stream 20 and passed into lower pressure column 18. Nitrogen-enriched vapor is withdrawn from the upper portion of high pressure column 11 in stream 21 and passed into main condenser 19 wherein it is condensed by indirect heat exchange with pressurized oxygen-rich liquid from the lower portion of the lower pressure column as will be more fully described below. Resulting condensed nitrogen-enriched liquid is withdrawn from main condenser 19 in stream 22. A first portion 23 of stream 22 is passed into the upper portion of higher pressure column 11 as reflux. A second portion 24 of nitrogen-enriched liquid 22 is passed into the upper portion of lower pressure column 18 as reflux.

Lower pressure column 18 is operating at a pressure less than that of higher pressure column 11 and generally within the range of from 15 to 50 psia. Within second or lower pressure column 18 the various feeds into the column are separated by cryogenic rectification into nitrogen-rich vapor and oxygen-rich liquid. Nitrogen-rich vapor is withdrawn from the upper portion of lower pressure column 18 in stream 25, warmed by passage through primary heat exchanger 9 and removed from the system in stream 26 which may be recovered in whole or in part as product nitrogen having a nitrogen concentration of at least 95 mole percent, preferably at least 99 mole percent. For product purity control purposes a waste stream 27 is taken from lower pressure column 18 at a level below the level from which stream 25 is withdrawn, warmed by passage through primary heat exchanger 9, and removed from the system in stream 28.

Oxygen-rich liquid is passed from the lower portion of lower pressure column 18 in liquid oxygen stream 29 to liquid pump 30 wherein it is increased in pressure. Cryogenic liquid pump 30 is a dual service liquid pump having a single feed stream 29 and two discharge streams 31 and 32. First liquid oxygen discharge stream 31 is at a pressure generally within the range of from 16 to 100 psia and has a flowrate generally within the range of from 80 to 400 percent of that of cleaned, pressurized feed air 7. Elevated pressure liquid oxygen stream 31 is passed into main condenser 19 which may be either a thermo-syphon main condenser or a downflow main condenser. Within main condenser 19 the liquid oxygen in stream 31 is at least partially vaporized by indirect heat exchange with the aforesaid condensing nitrogen-enriched vapor from higher pressure column 11. Resulting oxygen-rich fluid is then passed from main condenser 19 in stream 33 into the lower portion of lower pressure column 18.

Second liquid oxygen discharge stream 32 from liquid pump 30 is at a pressure higher than that of first discharge stream 31 and generally within the range of from 55 to 1000 psia, and has a flowrate less than that of first discharge stream 31 and generally within the range of from 5 to 21 percent of that of cleaned, pressurized feed air 7. Stream 32 may be recovered in whole or in part as product elevated pressure liquid oxygen product. In the embodiment of the invention illustrated in the FIGURE, stream 32 is passed through the product boiler section of primary heat exchanger 9 wherein it is vaporized by indirect heat exchange with the feed air in streams 8 and 14. Resulting vaporized oxygen-rich fluid is recovered as elevated pressure oxygen gas product in stream 34.

It is an important aspect of this invention that both the liquid oxygen passed into the main condenser and the liquid oxygen from which the product oxygen is recovered are pressurized by the same liquid pump. This significantly increases the efficiency by which the elevated pressure oxygen product is produced. Although the invention has been described in detail with reference to a certain preferred embodiment, those skilled in the art will recognize that there are other embodiments of the invention within the spirit and the scope of the claims.

What is claimed is:

1. A method for producing elevated pressure oxygen comprising:

(A) cooling feed air and passing the cooled feed air into a cryogenic air separation plant comprising a higher pressure column, a lower pressure column and a main condenser;

(B) separating the feed air within the cryogenic air separation plant by cryogenic rectification to produce oxygen;

(C) passing a liquid stream of oxygen from the lower portion of the lower pressure column to a liquid pump and increasing the pressure of the oxygen passed to the liquid pump to produce elevated pressure oxygen;

(D) passing a first stream of elevated pressure oxygen from the liquid pump to the main condenser; and (E) recovering a second stream of elevated pressure oxygen from the liquid pump as elevated pressure oxygen product.

2. The method of claim 1 wherein the first stream of elevated pressure oxygen from the liquid pump has a pressure within the range of from 16 to 100 psia.

3. The method of claim 1 wherein the second stream of elevated pressure oxygen from liquid pump has a pressure within the range of from 55 to 1000 psia.

4. The method of claim 1 further comprising recovering a nitrogen fluid from the lower pressure column having a nitrogen concentration of at least 95 mole percent.

5. The method of claim 1 wherein at least some of the second stream of elevated pressure oxygen from the liquid pump is vaporized prior to recovery.

6. The method of claim 5 wherein the said elevated pressure oxygen is vaporized by indirect heat exchange with at least some of the cooling feed air.

7. Apparatus for producing elevated pressure oxygen comprising:

(A) a cryogenic air separation plant comprising a high pressure column, a lower pressure column and a main condenser, and means for passing feed air into the cryogenic air separation plant;

(B) means for passing fluid from the higher pressure column to the main condenser, and means for passing fluid from the main condenser to the lower pressure column;

(C) a liquid pump and means for passing fluid from the lower portion of the lower pressure column to the liquid pump;

(D) means for passing fluid from the liquid pump to the main condenser; and (E) means for recovering fluid from the liquid pump as product elevated pressure oxygen.

8. The apparatus of claim 7 wherein the main condenser is a thermo-syphon main condenser.

9. The apparatus of claim 7 wherein the main condenser is a downflow main condenser.

10. The apparatus of claim 7 wherein the means for recovering fluid from the liquid pump as product elevated pressure oxygen includes a heat exchanger.

* * * * *